United States Patent [19]
Moro et al.
[11] 4,275,542
[45] Jun. 30, 1981

[54] WELDED STRUCTURE OF A POWER ARM

[75] Inventors: Christian D. Moro, Saint Pathus; Daniel G. Ranini, Varreddes, both of France

[73] Assignee: Poclain, France

[21] Appl. No.: 101,538

[22] Filed: Dec. 10, 1979

[30] Foreign Application Priority Data

Dec. 29, 1978 [FR] France ..... 78 36908

[51] Int. Cl.[3] ..... E04C 3/32
[52] U.S. Cl. ..... 52/731; 212/266; 414/694
[58] Field of Search ..... 52/730–732, 52/658, 93; 212/266; 414/694

[56] References Cited

U.S. PATENT DOCUMENTS

| | | | |
|---|---|---|---|
| 484,026 | 10/1892 | Larimer | 52/731 |
| 2,316,519 | 4/1943 | Labaree | 52/731 |
| 3,405,496 | 10/1968 | Van Der Meer | 52/731 |
| 3,882,654 | 5/1975 | Yancey | 52/731 |

FOREIGN PATENT DOCUMENTS

| | | | |
|---|---|---|---|
| 557517 | 5/1958 | Canada | 52/731 |
| 440655 | 7/1912 | France | 52/731 |
| 1410683 | 8/1965 | France . | |
| 2273121 | 5/1975 | France . | |
| 392811 | 10/1965 | Switzerland . | |

*Primary Examiner*—James L. Ridgill, Jr.
*Attorney, Agent, or Firm*—Lerner, David, Littenberg & Samuel

[57] ABSTRACT

The invention relates to a power arm made of a bent, welded structure defined by two lateral plates and by an upper plate and a lower plate welded to the lateral plates and comprising a box having an upper cap and a lower base forming a cross piece of width equal to the spacing of the lateral plates, disposed between these plates in the zone of their elbow and welded to said plates. The cap and the case join, forming two angles, along two lines which pass substantially through the neutral axis of each lateral plate. The invention finds particular application in the manufacture of the boom of a hydraulically operated shovel.

4 Claims, 6 Drawing Figures

FIG. 1
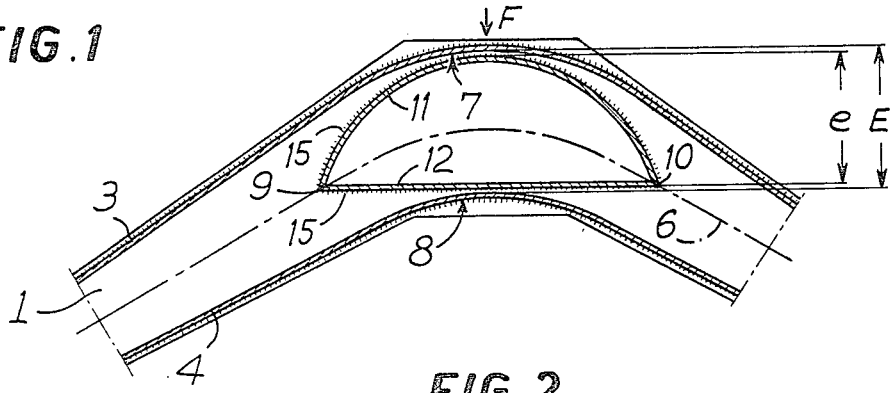
FIG. 2
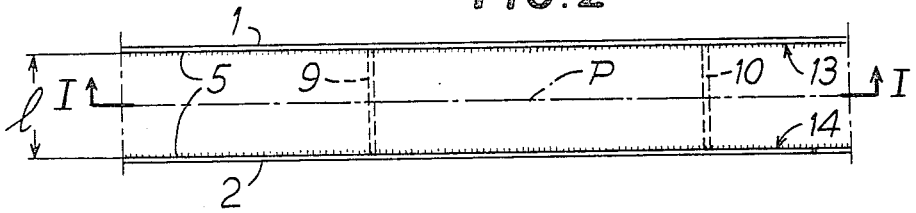
FIG. 3
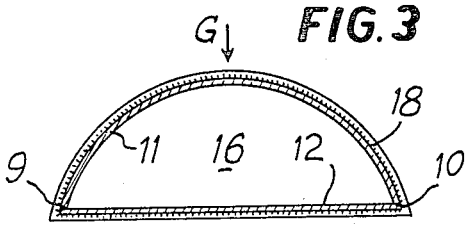
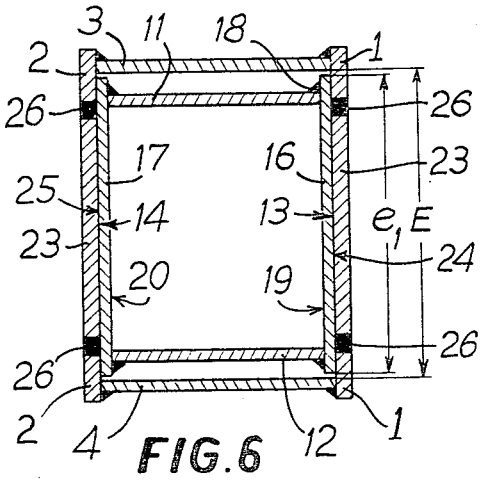
FIG. 6
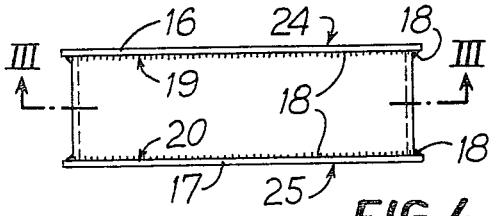
FIG. 4
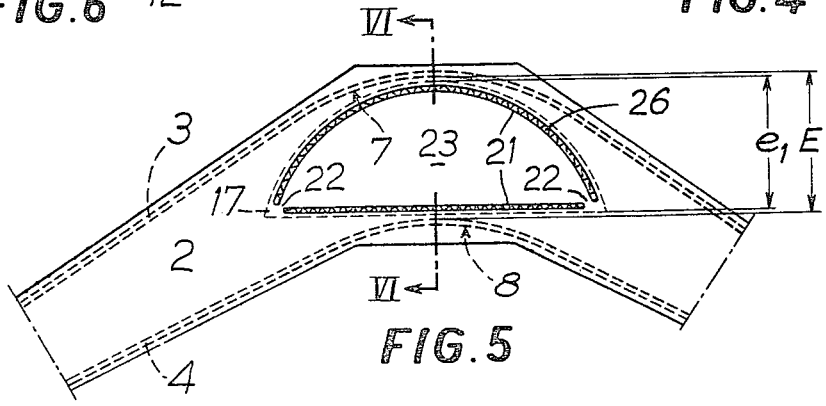
FIG. 5

WELDED STRUCTURE OF A POWER ARM

The present invention relates to the welded structure of a power arm.

The technique of welding is widely used in mechanical construction, including the manufacture of slender beams in flexion and/or in torsion. These beams are often integrated in mechanisms by bolt or pivot pin assemblies. Such beams then constitute power arms made in welded structures.

As the general transverse dimensions of these power arms are small, it is often difficult to position the reinforcements necessary for obtaining a good holding during operation. It is an object of the present invention to remedy this state of affairs by proposing a novel structure noteworthy both by its high mechanical strength and by the relatively simple manufacture thereof.

It is therefore an object of the invention to provide a welded structure of a power arm, such as the boom of a hydraulically operated shovel, constituted by:

two lateral plates, each being substantially flat, oblong, whilst its longitudinal axis, neutral in flexion in its plane, presents an elbow between its ends, and the two lateral plates have substantially identical shapes and are disposed opposite each other, substantially in parallel, an upper plate and a lower plate, which extend in the zone of the upper and lower edges respectively of said two lateral plates, on either side of said neutral axis of each of these lateral plates, and which are welded to said lateral plates, and, a box which comprises an upper cap and a lower base, forming a cross piece, is disposed between the lateral plates in the zone of said elbow of their neutral axes respectively, and this box being welded to said lateral plates.

The cap and the base join, forming two angles, along two lines which pass substantially through said neutral axis of each lateral plate.

The following arrangement is advantageous: the spacing between the outer faces of said cap and base in the median zone of these elements is substantially equal to the spacing of the inner faces of the upper and lower plates at this spot.

According to one embodiment, the box is constituted solely by said cap and base, whose edges are welded to the lateral plates.

According to another embodiment, the box further comprises two closure plates on whose inner faces are welded said cap and base, and whose outer faces are assembled on the lateral plates by plug welds along the edges of slots made to this end in these lateral plates.

The invention will be more readily understood on reading the following description with reference to the accompanying drawings, in which:

FIG. 1 is a longitudinal section along I—I of FIG. 2, through the boom of a shovel according to the invention;

FIG. 2 is a view in the direction of arrow F of FIG. 1;

FIG. 3 is a transverse section through a box used in the structure, according to the invention, of the boom of FIG. 5, along III—III of FIG. 4;

FIG. 4 is a view in the direction of arrow G of FIG. 3;

FIG. 5 is a view in elevation of a boom according to the invention; and

FIG. 6 is a section along VI—VI of FIG. 5.

Referring now to the drawings, the boom of a hydraulic shovel shown in FIGS. 1 and 2 is constituted by two flat, parallel, vertically disposed plates 1 and 2 constituting the sides of the boom, and by two other plates 3 and 4 of constant width 1, which are disposed between the sides 1 and 2 and are rendered fast therewith by weld beads 5.

The upper plate 3 is placed above the neutral axis 6 of flexion parallel to the longitudinal plane P of the boom of each of the two identical sides 1 and 2; the lower plate 4 is placed below the neutral axis 6. To simplify matters, it will further be assumed that this neutral axis 6 of each side 1, 2 merges with the neutral axis of flexion of the assembled boom (plates 1,2,3, and 4 assembled).

It will be noted that the upper and lower plates 3 and 4 respectively each present an elbow 7 and 8 respectively in their intermediate part and that the direction of sides 1 and 2 changes corresponding to the location of said elbows 7, 8.

Furthermore, a box is formed by welding along two lines 9 and 10 of two plates, the upper one, 11, of arcuate section, forming the cap of the box, the other, lower one, 12, which is flat, forming the base of the box, both having a width equal to the width l of the upper and lower plates 3 and 4 respectively and, consequently, to the spacing of the inner faces 13, 14 of the sides 1, 2. Along the lines 9 and 10, the cap 11 and base 12 joined in two dihedrons form two angles.

This box is disposed between the sides 1 and 2, in the zone of the elbows 7 and 8, the lines 9 and 10 being placed so as to pass substantially through the neutral axes 6, the cap 11 located above, and the base 12 below these neutral axes. After having been arranged in this way, it is then welded (15) to the inner faces 13, 14 of the sides 1,2. For this weld 15 to be possible, whilst the box is located inside the boom when said boom is manufactured in its final form, it was naturally necessary to make it before the upper and lower plates 3 and 4 were placed in position.

In a variant, the making of the plug weld 15, similarly to the embodiment of FIGS. 5 and 6, would enable the box to be assembled after the upper and lower plates 3 and 4 respectively have been placed in position.

It will finally be noted that the spacing e of the outer faces of the cap 11 and base 12 of the box, disposed opposite the central zones of the elbows 7,8, has a value substantially equal to, although slightly less than, that of the spacing E of the inner faces of said central zones of the elbows 7,8.

The embodiment of FIGS. 3 to 6 includes many elements and arrangements already defined, which are naturally provided with the same references.

The novelty with respect to the embodiment of FIGS. 1 and 2 lies in the structure of the box which, this time, further comprises two closure plates 16, 17 whose inner faces 19, 20 are welded (18) to the extreme edges of the cap 11 and base 12.

To fix this box on the sides 1,2, slots 21 are made in each of these sides, by milling or oxyacetylene cutting for example, which slots leave two tongues 22 enabling the piece 23 which is inside each slot and which is almost detached from the corresponding side, to be maintained in position on the rest of the side. The box being disposed so as to place its closure plates 16, 17 behind the slots 21, the outer faces 24, 25 of said closure plates are then plug welded (26) to the sides 1,2 and to the pieces 23 which remained attached.

The following points should be noted:

the spacing of the outer faces 24, 25 of the closure plates 16, 17 is equal to the width l of the upper and lower plates 3 and 4 respectively and consequently to the spacing of the inner faces 13, 14 of the sides 1,2;

the spacing $e_1$ of the upper and lower edges of plates 16, 17 has a value substantially equal to, although slightly less than, that of spacing E;

the coupling devices (welded lugs, for example) of the or each jack for adjusting the position of the boom have not been shown, as they are of a type known in the art of manufacturing booms.

The advantages of the above-described arrangements will now be seen.

Firstly, the presence in the zone of the elbows 7 and 8 of a box whose cap and base are disposed on either side of the neutral axes 6, reinforces the flexural strength of the boom parallel to plane P.

The box of the boom of FIGS. 1 and 2 is simple to manufacture. However, the embodiment of FIGS. 3 and 4 may be preferred, which allows the box to be manufactured entirely independently.

Moreover, the manufacture of the box, as shown in FIGS. 3 and 4, brings a further advantage in the application made thereof in the boom of FIGS. 5 and 6; the closure plates 16, 17 reinforce the sides 1,2 as far as their buckling strength is concerned, allowing a thickness of the plates of sides 1,2 to be chosen which is smaller than that necessary in the absence of the box, for a given height of sides.

Finally, the values of the spacings e or $e_1$ of the cap 11 and base 12 or of the upper and lower edges of the closure plates 16, 17, with respect to the value of the spacing E of the elbows 7 and 8 make it easy to adjust the position of the upper and lower plates 3 and 4 respectively with respect to the corresponding box, at the moment of assembly, by simple bearing between these elements.

The increase in torsional strength of the booms provided with the boxes described and shown will also be readily appreciated.

What is claimed is:

1. In a welded structure of a power arm, such as the boom of a hydraulically operated shovel, constituted by:

two lateral plates each being substantially flat, oblong, whilst its longitudinal axis, neutral in flexion in its plane, presents an elbow between its ends, and the two lateral plates have substantially identical shapes and are disposed opposite each other, substantially in parallel, an upper plate and a lower plate which extend in the zone of the upper and lower edges respectively of the said two lateral plates on either side of said neutral axis of each of these lateral plates, and which are welded to said lateral plates, and a box which comprises an upper cap and a lower base, forming a cross piece, is disposed between the lateral plates in the zone of said elbow of their neutral axes, said cap and base being located at least partly above and below the neutral axes, respectively, and said box is welded to said lateral plates, the cap and base join, forming two angles, along two lines which pass substantially through said neutral axis of each lateral plate.

2. The structure of claim 1, wherein the spacing between the outer faces of said cap and base in the median zone of these elements is substantially equal to the spacing of the inner faces of the upper and lower plates at this spot.

3. The structure of claim 1, wherein the box is constituted solely by said cap and base, whose edges are welded to the lateral plates.

4. The structure of claim 1, wherein the box further comprises two closure plates, on whose inner faces are welded said cap and base, and whose outer faces are assembled on the lateral plates by plug welds along the edges of slots made to this end in the said lateral plates.

* * * * *